US007334772B2

(12) United States Patent
Carepa

(10) Patent No.: US 7,334,772 B2
(45) Date of Patent: Feb. 26, 2008

(54) PRESSURIZED BREATHABLE GAS PRESSURE REGULATOR

(75) Inventor: Stéphane Carepa, Carros (FR)

(73) Assignee: La Spirotechnique Industrielle et Commerciale, Carros (FR)

( * ) Notice: Subject to any disclaimer, the term of this patent is extended or adjusted under 35 U.S.C. 154(b) by 180 days.

(21) Appl. No.: 11/078,445

(22) Filed: Mar. 14, 2005

(65) Prior Publication Data

US 2006/0157123 A1 Jul. 20, 2006

(30) Foreign Application Priority Data

Jan. 18, 2005 (FR) ..... 05 50143

(51) Int. Cl.
*F16L 29/00* (2006.01)
*G05D 16/06* (2006.01)

(52) U.S. Cl. ..... 251/149.6; 137/613; 128/205.24

(58) Field of Classification Search ..... 137/505.25, 137/505, 613; 251/149.6, 149.1, 149.4; 128/205.24
See application file for complete search history.

(56) References Cited

U.S. PATENT DOCUMENTS 4,094,314 A * 6/1978 Le Cornec ..... 251/174
6,089,259 A * 7/2000 Shuman, Jr. ..... 137/505.25
6,484,720 B1 * 11/2002 Marquard et al. ..... 128/205.24
6,601,609 B2 8/2003 Taylor
6,691,978 B1 * 2/2004 Bartos et al. ..... 251/149.6
6,901,958 B2 6/2005 Taylor
7,185,674 B2 3/2007 Taylor
2004/0079419 A1 4/2004 Taylor et al.

FOREIGN PATENT DOCUMENTS

EP 1681232 A1 * 7/2006

* cited by examiner

*Primary Examiner*—Kevin Lee
(74) *Attorney, Agent, or Firm*—Young & Thompson

(57) ABSTRACT

The high pressure gas inlet channel (6) of the pressure regulator (1) is formed upstream in a stationary valve element (7) having an enlarged terminal head (9) interacting with a seat edge of a movable seat (10) acted upon in closure position by a spring (23), the mounting of the pressure regulator (1) in the high pressure gas inlet tap body (3) causing the retraction of the seat (10) and the opening of the inlet channel normally kept blanked off during operations of storage and/or washing of the pressure regulator.

Applies mainly to sea diving pressure regulators.

11 Claims, 3 Drawing Sheets

PRESSURIZED BREATHABLE GAS PRESSURE REGULATOR

BACKGROUND OF THE INVENTION

The present invention concerns pressurized breathable gas pressure regulators, of the type comprising one end connectable to a body of a high pressure gas inlet tap, this end defining a pressurized gas inlet channel, particularly for mixing breathing gas for divers or firefighters/rescuers.

These types of pressure regulators are connected and disconnected to/from the tap/gas tank assembly before and after each use. In the field of sea diving, after each use, the pressure regulators are rinsed in fresh water and then stored in free air.

To prevent the ingress of foreign bodies (dust, damp, grease, etc) into the pressure regulator during its storage and possible rinsing, a proposal has been made to fit onto the connection end an articulated blanking element, for example of the cover type, that can be actuated manually. This manual actuation not only makes the connection end complex and fragile and prevents the installation of a protective cap, but also makes the connection procedure complex and does not protect against the ingress of foreign bodies just before or after the connection/disconnection with the tap/bottle assembly.

SUMMARY OF THE INVENTION

The object of the present invention is to propose a simple, robust and reliable arrangement for an automatic blanking off or opening of the gas inlet channel during connection to the tap body and suitable equally for "yoke" type or "DIN" type connections.

To do this, according to one feature of the invention, the inlet channel terminates in a stationary valve element interacting with a movable seat acted upon by an elastic means in a position of blanking off the inlet channel and comprising an external face capable of interacting in engagement with a corresponding surface of the tap body to push back the movable seat when coming into contact with the elastic means to an open position during connection with the tap body.

According to other features of the invention:

- the movable seat is annular and forms a seat edge interacting with a rear surface, typically frustoconical, of a portion of the terminal head of the valve element
- the external face of the movable seat is an annular end face interacting with a shoulder formed in the tap body
- the end of the pressure regulator is screwed into or pressed against the tap body by a yoke screw.

BRIEF DESCRIPTION OF THE DRAWINGS

Other features and advantages of the invention will emerge from the following description of embodiments, given for information but in no way limiting, made with reference to the appended drawings, in which.

DETAILED DESCRIPTION OF THE PREFERRED EMBODIMENTS

Figure 2:
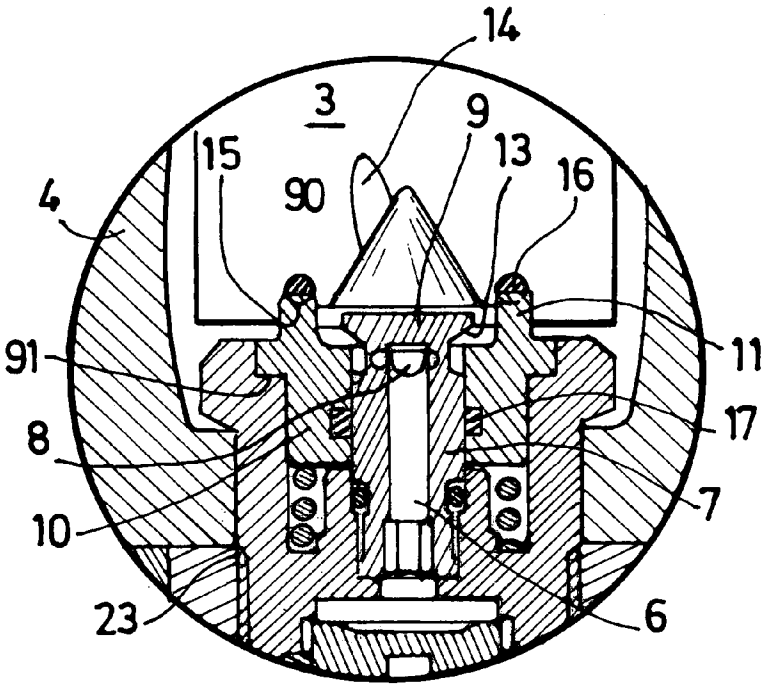
FIG. 2 is an enlarged view in partial section of the whole of FIG. 1 in a configuration of interconnection with the tap body.

In the following description and in the drawings, identical or similar items bear the same reference numbers, indexed where necessary.

Figure 1:
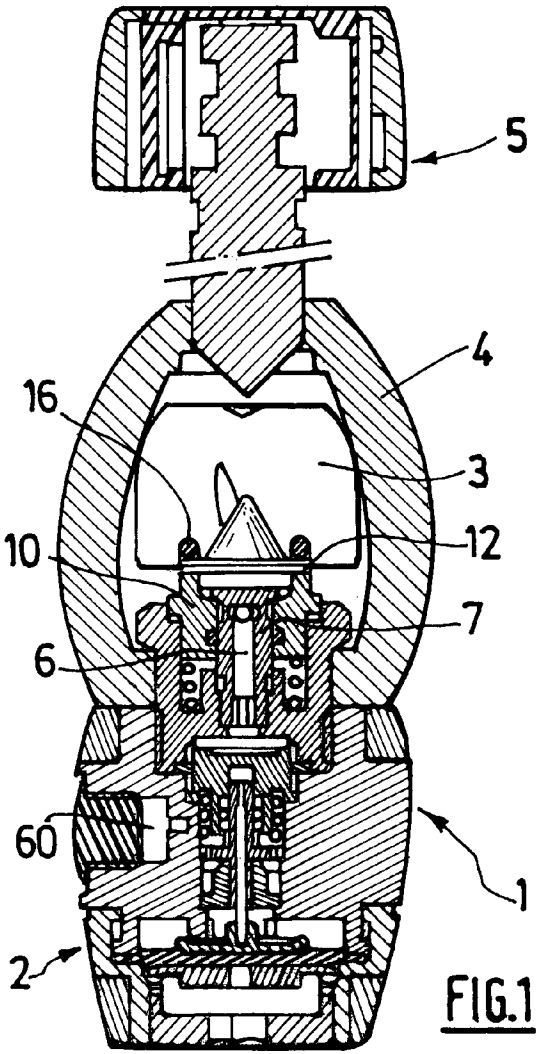
FIG. 1 is a schematic view in section of a first embodiment according to the invention for a connection of the "yoke" type.

The embodiment in FIGS. 1 and 2 shows a pressure regulator block 1 incorporating an integrated pressure regulator device with membrane 2 intended to be connected to a tap body 3 via, in the "yoke" connection mode, a yoke 4 fixedly attached to the block 1 receiving the tap body 3 and supporting a pressure screw 5 intended to press the tap body 3 in connection position against the pressure regulator block 1. The latter comprises at least one medium/low pressure gas outlet 60 of the gas fed by the tap body 3 toward the pressure regulator device 2 via a pressurized gas inlet channel 6 leading to the outside of the connection end of the pressure regulator block 1.

As can be better seen in FIG. 2, according to one aspect of the invention, the inlet channel 6 is formed, at its entrance, by a blind coaxial bore of a tubular valve element 7 mounted stationary in the connection end of the pressure regulator block 1, the blind bore 6 leading to the outside via radial passages 8 formed beneath an enlarged terminal head 9 of the element 7.

According to one aspect of the invention, around the stationary valve element 9 is mounted in sliding motion an annular seat 10 having a protruding annular outer end or collar 11 forming an annular end face 12 around the head 9, the inner recess of the annular collar 11 being connected internally with the sliding bore of the seat 10 on the tubular element 9 by a seat edge 90 normally acted upon in engagement with the rear frustoconical face 13 of the head 9 by a spring 23 resting in the pressure regulator block 1 and pushing the seat 10 outward.

In the embodiment shown, the tap body 3 comprises, around the channel 14 letting in the pressurized gas from a pressurized gas container or bottle, a cup of the same transverse dimension as the collar 11 and defining an internal annular shoulder 15 interacting in engagement, when the tap body 3 is pressed by the screw 5 against the pressure regulator block 1, with the annular end face 12 of the movable seat 10, thus pushing the latter inward against the spring 14 and opening the passage between the seat edge 90 and the face 13 of the head 9. The backward movement of the seat 10 in the pressure regulator block 1 is limited by a rear shoulder 91 of the seat butting against a corresponding shoulder of the body 1.

In the embodiment shown, the seal in the connection configuration between the shoulder 15 of the body 3 and the annular end face 12 of the seat 10 is provided by a seal 16 mounted in the bottom of the cup of the tap body 3 and the seal between the movable seat 10 and the stationary valve element 9 is provided by a sliding seal 17 mounted in the seat 10. The positioning of the seals 16 and 17 between the two pieces may be inverted.

Figure 3:
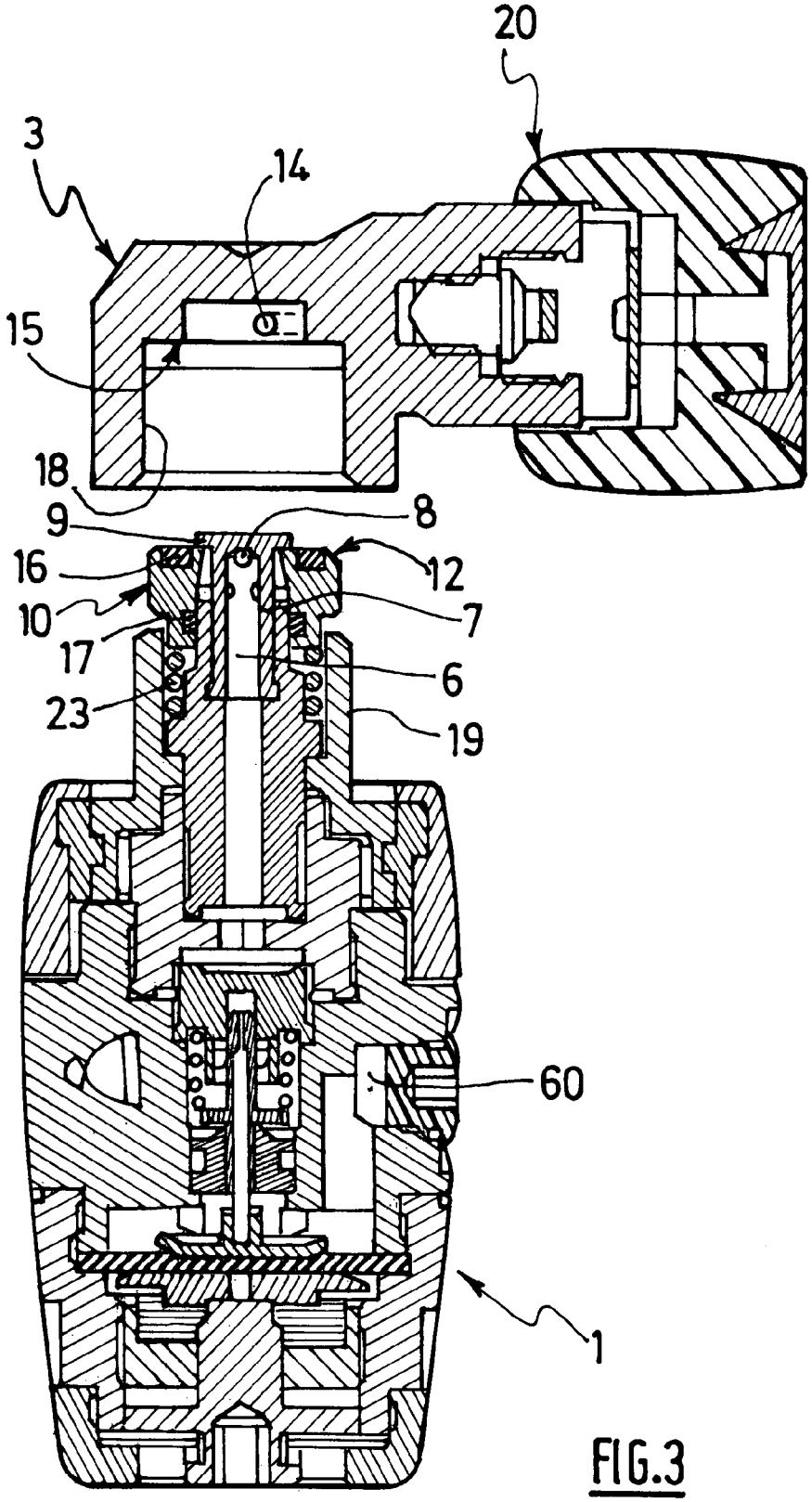
FIG. 3 is a schematic view in section before assembly of another embodiment of the invention for a "DIN" type connection.
Figure 4:
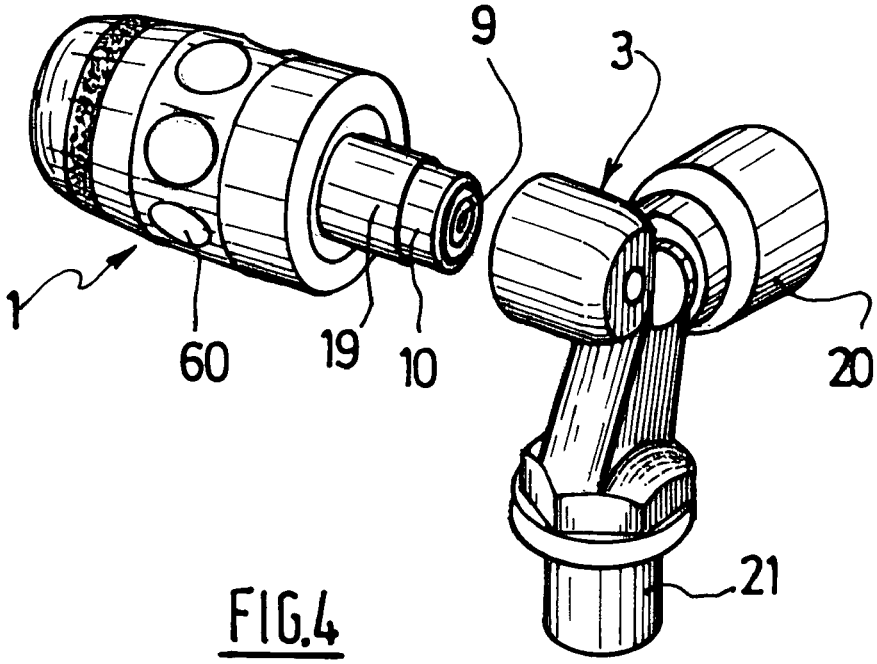
FIG. 4 is a view in perspective of the assembly of FIG. 3.
Figure 5:
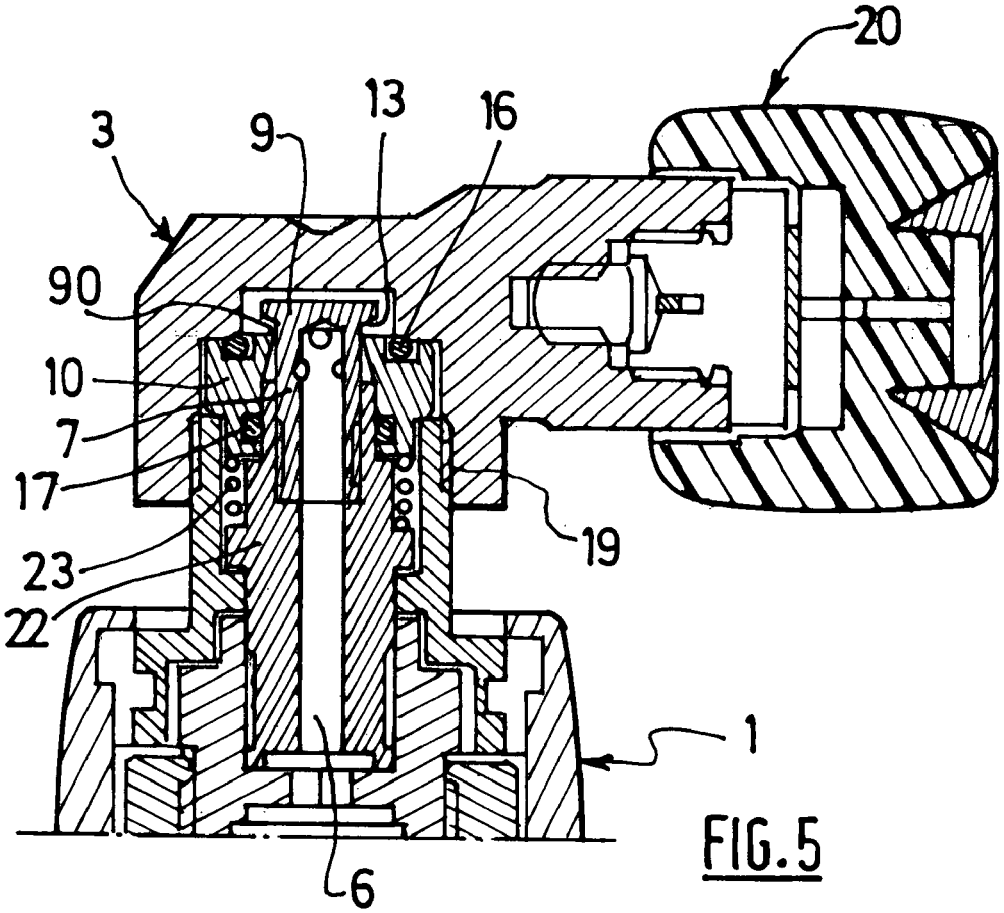
FIG. 5 is a view in partial section of the assembly in FIG. 3 in the connected configuration.

The embodiment for the "DIN" type connection shown in FIGS. 3 to 5 again shows the connection end of the pressure regulator block 1 with its stationary valve element 9 surrounded by the movable seat 10, acted upon in closed position by the spring 23, this set here being intended to be entirely received in a hollow cup 18 of the tap body 3 forming, at its bottom, still around the pressurized gas inlet channel 14, the abutment shoulder 15 and comprising a tapped front end intended to be screwed into the threaded tubular end 19 of the pressure regulator block 1 housing the movable seat 10. As can be seen in FIGS. 3 to 5, the tap body 3 supporting the open/closed tap 20, is fixedly attached, in this embodiment, to a threaded base 21 intended to be mounted in the neck of a pressurized gas bottle (not shown).

As can be seen in FIG. 5, when the threaded end 19 of the pressure regulator block 1 is screwed into the cavity 18 of the tap body 3, the shoulder 15 presses against the annular end face 12 of the movable seat 10 to push the latter back inward, against the spring 23, and open the passage between the rear contact surface 13 and the seat edge 90.

In the embodiment shown, the seal between the abutment faces 12 and 15 is provided by an O-ring 16 mounted in the movable seat 10 and the sliding motion seal of the latter is provided by a sliding seal 17 interacting here with the peripheral wall of a barrel 22 for mounting the stationary valve element 9 in the pressure regulator block 1. The assemblies of the seals 16 and 17 may also be inverted.

It is evident from the foregoing that, with the arrangement according to the invention, at rest in the storage or washing position, the entrance passage of the inlet channel 6 is hermetically blanked off, the mere connection of the pressure regulator block 1 with the tap body 3 opening this passage to create and maintain a stable determined entrance cross section sufficient to satisfy the breathing performance of a user of the pressure regulated breathing gas, irrespective of the high supply pressure of the latter.

In addition, the arrangement according to the invention, with its movable seat, allows the user to rotate the pressure regulator block even in the pressurized connected configuration, users having the annoying habit of forcing the connection of the pressure regulator block to move the medium pressure outlets of the latter into a determined position. The movable seat according to the invention gives a degree of freedom to the connection in the axis of the tap body which prevents the possibility of generating a torque to loosen the pressure regulator block.

Although the invention has been described in relation to particular embodiments, it is not limited thereby but is amenable to modifications and variants that will appear to those skilled in the art in the context of the following claims. Thus, in the rest position, the outer end of the movable seat 10 may be covered by a tear-off or removable protective cap.

The invention claimed is:

1. A pressure regulator for pressurized breathable gas, having one end connectable to a body of a high pressure gas inlet tap, said one end defining a gas inlet channel, wherein the gas inlet channel (6) terminates in a stationary valve element (7) interacting with a movable seat (10) acted upon by an elastic means (14) in a position of closure of the inlet channel and comprising an external face (12) capable of interacting in engagement with a corresponding surface (15) of the tap body (3) to push back the movable seat (10) when coming into contact with the elastic means (14) to an open position of the inlet channel (6) during connection with the tap body (3).

2. The pressure regulator according to claim 1, wherein the movable seat (10) is annular and forms a seat edge (90) interacting with a rear surface (13) of a terminal head (9) of the valve element (7).

3. The pressure regulator according to claim 2, wherein the external face of the movable seat (10) is an annular end face (12) interacting with a shoulder (15) formed in the tap body (3).

4. The pressure regulator according to claim 3, further comprising an O-ring (16) mounted in the annular end face (12) or in the shoulder (15).

5. The pressure regulator according to claim 2, wherein the annular seat (10) is mounted in sealed sliding motion (17) on the valve element (7).

6. The pressure regulator according to claim 2, wherein the movable seat (10) is mounted with sealed sliding motion (17) on a tubular piece (22) for mounting the valve element in the pressure regulator (1).

7. The pressure regulator according to claim 2, wherein the end of the pressure regulator (1) is screwed (18; 19) into the tap body (3).

8. The pressure regulator of claim 1, wherein the tubular element and the annular seat are mounted for a sliding movement around the stationary valve element.

9. The pressure regulator of claim 1, wherein said gas inlet channel (6) is connected to the outside via radial passages (8) formed beneath an enlarged terminal head (9) of the stationary valve element (7).

10. The pressure regulator according to claim 1, wherein said annular seat (10) has a protruding annular outer collar (11) forming said external face (12).

11. A pressure regulator for pressurized breathable gas, having one end connectable to a body of a high pressure gas inlet tap, said one end defining a gas inlet channel, wherein the gas inlet channel (6) terminates in a stationary valve element (7) interacting with a movable seat (10) acted upon by an elastic means (14) in a position of closure of the inlet channel and comprising an external face (12) capable of interacting in engagement with a corresponding surface (15) of the tap body (3) to push back the movable seat (10) when coming into contact with the elastic means (14) to an open position of the inlet channel (6) during connection with the tap body (3), and wherein the tap body (3) is pressed against the end of the pressure regulator (1) by a screw (5) of a yoke (4).

* * * * *